US010047646B2

(12) United States Patent
Muster et al.

(10) Patent No.: US 10,047,646 B2
(45) Date of Patent: Aug. 14, 2018

(54) CAMSHAFT HAVING AT LEAST ONE AXIALLY FIXED SLIDING ELEMENT

(71) Applicant: ThyssenKrupp Presta TecCenter AG, Eschen (LI)

(72) Inventors: Manfred Muster, Ludesch (AT); Aaron Pfitscher, Ludesch (AT); Marko Curlic, Schaanwald (LI); Volker Junge, Wernigerode (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 0 days.

(21) Appl. No.: 15/524,295

(22) PCT Filed: Aug. 4, 2015

(86) PCT No.: PCT/EP2015/067877
§ 371 (c)(1),
(2) Date: May 4, 2017

(87) PCT Pub. No.: WO2016/071017
PCT Pub. Date: May 12, 2016

(65) Prior Publication Data

US 2017/0321578 A1 Nov. 9, 2017

(30) Foreign Application Priority Data

Nov. 6, 2014 (DE) ..... 10 2014 116 195

(51) Int. Cl.
*F01L 1/34* (2006.01)
*F01L 13/00* (2006.01)
*F01L 1/047* (2006.01)

(52) U.S. Cl.
CPC ..... *F01L 13/0036* (2013.01); *F01L 1/047* (2013.01); *F01L 2001/0473* (2013.01); *F01L 2013/0052* (2013.01)

(58) Field of Classification Search
CPC ..... F01L 1/047; F01L 13/0036; F01L 2001/0473; F01L 2013/0052
(Continued)

(56) References Cited

U.S. PATENT DOCUMENTS 4,124,318 A 11/1978 Sagady
8,662,043 B2 * 3/2014 Dollinger ..... B21D 53/845 123/90.16

FOREIGN PATENT DOCUMENTS

DE 102004011586 A 10/2004
DE 102008028513 A 12/2009
(Continued)

OTHER PUBLICATIONS

English translation of International Search Report issued in PCT/EP2015/067877, dated Nov. 23, 2015 (dated Dec. 23, 2015).
(Continued)

*Primary Examiner* — Ching Chang
(74) *Attorney, Agent, or Firm* — thyssenkrupp North America, Inc.

(57) ABSTRACT

A camshaft for a multiple-cylinder internal combustion engine may include a sliding element comprising at least two cam elements, as well as a splined shaft that extends in an axial direction and on which the sliding element is received. The sliding element may comprise an internal spline system that interacts with an external spline system of the splined shaft such that the sliding element is seated fixedly on the splined shaft so as to rotate with the splined shaft. The sliding element may be received on the splined shaft such that the sliding element can, at least initially, be displaced axially. For axially-fixing the sliding element to the splined shaft, the sliding element may include a positively locking connection that is configured in the axial direction and is produced by way of at least one calked connection between the sliding element and the splined
(Continued)

shaft. It should be understood that many camshafts include more than one sliding element.

14 Claims, 3 Drawing Sheets

(58) Field of Classification Search
USPC ..... 123/90.16, 90.6, 90.18; 29/888.1
See application file for complete search history.

(56) References Cited

FOREIGN PATENT DOCUMENTS

| | | | |
|---|---|---|---|
| DE | 202009015465 | U | 2/2010 |
| DE | 102009030373 | A | 12/2010 |
| DE | 102009024455 | A | 1/2011 |
| DE | 102010047993 | A | 4/2012 |
| JP | 2003184994 | A | 7/2003 |

OTHER PUBLICATIONS

English abstract of DE102009024455.
English abstract of DE102010047993.
English abstract of DE102004011586.

* cited by examiner

CAMSHAFT HAVING AT LEAST ONE AXIALLY FIXED SLIDING ELEMENT

CROSS REFERENCE TO RELATED APPLICATIONS

This application is a U.S. National Stage Entry of International Patent Application Serial Number PCT/EP2015/067877, filed Aug. 4, 2015, which claims priority to German Patent Application No. DE 10 2014 116 195.5 filed Nov. 6, 2014, the entire contents of both of which are incorporated herein by reference.

FIELD

The present disclosure generally relates to camshafts, including camshafts and methods for producing camshafts for multiple-cylinder internal combustion engines.

BACKGROUND

DE 10 2004 011 586 A1 describes a valve train for a multiple-cylinder internal combustion engine, and the valve train comprises camshafts which are constructed substantially from a splined shaft and a plurality of sliding elements. The sliding elements have an internal spline system which engages into an external spline system on the splined shaft, with the result that the sliding elements are received fixedly on the splined shaft so as to rotate with it, but remain axially movable. Via external actuators, the sliding elements can be moved to and fro axially between discrete positions during operation, in order, for example, to actuate a tapping element via different cam elements, and in order to change the control movement of the valves accordingly.

Depending on the overall design of the valve train and the camshafts, cam elements which are arranged in an axially fixed manner are required, and at the same time the camshaft is to comprise axially displaceable cam elements which are configured, for example, on sliding elements. Here, in order to form the axially fixed cam elements, the sliding elements are pinned to the splined shaft, and, for example, a pin can be guided in a transverse direction through the splined shaft and through the support tube of the sliding element. In this way, the sliding element is fixed axially on the splined shaft, whereas, for example, adjacent sliding elements continue to remain received on the splined shaft in an axially movable manner.

Pinning of the support tubes on the supply shaft is disadvantageously complicated and requires a corresponding adaptation of the pinning means. Furthermore, during later operation of the camshaft, the sliding elements are always seated on the same section of the splined shaft, as a result of which a relatively great radial play can be configured and as a result of which the smooth running properties of the sliding elements on the splined shaft deteriorate further.

DETAILED DESCRIPTION

Figure 1:
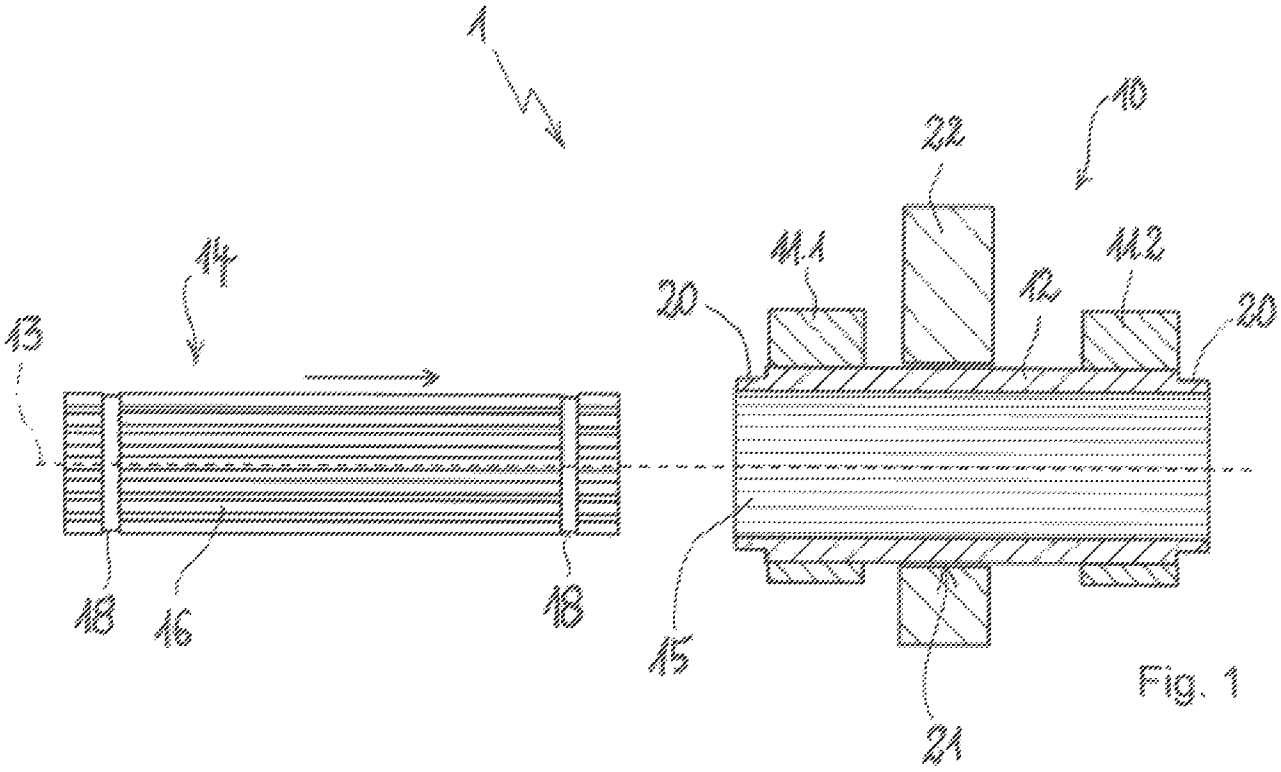
FIG. 1 is a sectional view of an example camshaft in a non-mounted arrangement of a sliding element on a splined shaft.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

One example object of the present disclosure concerns a camshaft with at least one axially fixed sliding element on a splined shaft, wherein the axial fixing is of simple configuration. In particular, a residual mobility of an axially fixed sliding element on the splined shaft is to be avoided. To that end, in some respects the present disclosure relates to a camshaft for a multiple-cylinder internal combustion engine with sliding elements comprising at least two cam elements for control of valves of the internal combustion engine, and with a splined shaft that extends in an axial direction and on which the sliding elements are received, and the sliding elements comprising an internal spline system that interacts with an external spline system of the splined shaft, with the result that the sliding elements are seated fixedly on the splined shaft so as to rotate with it, and at least one sliding element being received on the splined shaft such that it can be displaced axially.

The invention includes the technical teaching that, for axial fixing to the splined shaft, at least one of the sliding elements comprises a positively locking connection which is configured in the axial direction and is produced by way of at least one calked connection between the sliding element and the splined shaft.

The invention proceeds from the general concept of producing a positively locking connection between the sliding element and the splined shaft, which positively locking connection fixes the sliding element on the splined shaft in the axial direction. The calked connection can be provided once or multiple times between the sliding element and the splined shaft, and the calked connection describes any form of plastic, permanent deformation of a material section of the support tube, by way of which the positively locking connection to the splined shaft is formed. The form, the geometric configuration and the size of the calked connection is not restricted here by the term "calked connection" itself. For example, a prepared material section, for example a tongue, a tab or the like, can also be configured on the first joining part, that is to say on the sliding element or on the splined shaft, which is bent against the respectively other joining part. As a result, a simple connection with minimum costs and which can be carried out easily is provided between the sliding element and the splined shaft, and even only minimum movements of the sliding element on the splined shaft are avoided by way of the at least one calked connection. In particular, no play can be built up between the sliding element and the splined shaft, and the external spline system of the splined shaft does not have to form an interference fit or a transition fit with the internal spline system of the sliding element.

The calking can be performed on the sliding element or on the splined shaft. For example, the splined shaft can have an interruption of the external spline system, which interruption is configured at at least one axial position and into which a material part of the sliding element is calked in sections, and/or it can be provided that the sliding element has a receiving geometry, into which a material part of the splined shaft is calked in sections.

The splined shaft can particularly advantageously comprise an interruption of the external spline system, which interruption is configured at at least one axial position and into which a material portion of the sliding element and, in particular, of the support tube is calked in sections. The interruption can particularly advantageously be configured as a circumferential groove in the external spline system, and the groove can comprise a depth which corresponds to the depth of the spline system. For example, the groove bottom can comprise a radius which coincides with the radius of the tooth root circle of the external spline system of the splined shaft. As an alternative, the interruption can also be formed by individual teeth of the external spline system comprising the interruption, and finally the material part of the support tube can be calked in sections into the interruption. The material part in sections is preferably formed on the outer edge of the support tube, but can also be configured spaced apart from the outer edge, for example adjacently with respect to the setting location of a cam element on the support tube.

According to one advantageous embodiment of the camshaft according to the invention, the support tube can comprise at least one end-side section with a reduced tube wall thickness. Here, the calked connection can be configured in the region of the end-side section, with the result that the material part lies in sections in said region of the reduced tube wall thickness.

At least two, preferably at least three and particularly preferably four calked connections can further advantageously be formed into an interruption of the external spline system in a manner which is distributed on the circumference of the support tube, it also being possible for more than four calked connections to be provided. For example, a calked connection can be provided in each intermediate space between two teeth of the external spline system, or a calked connection is formed in an isolated manner into the tooth intermediate spaces. In particular, the calked connections can be provided at both end sides of the support tube, with the result that, in the case of two calked connections on one end side of the support tube, a total of four calked connections, for example, are formed between the support tube and the splined shaft.

According to a further advantageous embodiment, the sliding element can comprise a bearing section, by way of which the sliding element can be received in a rotatably mounted manner on a bearing bracket. If the camshaft comprises sliding elements which are received on the splined shaft in an axially displaceable manner, and if the camshaft comprises sliding elements which are fixed axially on the splined shaft by way of the method according to the invention, a special advantage is achieved by virtue of the fact that the sliding elements which are fixed on the splined shaft via the method according to the invention of calking are mounted in bearing brackets of a component which receives the camshaft, for example a cover module or a cylinder head. The bearing section can be situated, for example, between two setting locations, at which cam elements are attached on the support tube.

Furthermore, the invention is directed to a method for producing a camshaft for a multiple-cylinder internal combustion engine, the camshaft comprising a plurality of sliding elements which comprise at least two cam elements for controlling valves of the internal combustion engine, and a splined shaft being provided which extends in an axial direction and extends through the sliding elements, the sliding elements comprising an internal spline system which interacts with an external spline system of the splined shaft, with the result that the sliding elements are seated fixedly on the splined shaft so as to rotate with it, and at least one sliding element being axially displaceable, the method comprising at least the following steps: provision of the sliding elements and the splined shaft, guiding of the splined shaft through the sliding elements, and production of a calked connection between the sliding element and the splined shaft in order to form a positively locking connection for axially fixing the at least one sliding element on the splined shaft in the axial direction.

The method provides, in particular, that the sliding element is provided with a support tube which comprises at least one end-side section with a reduced tube wall thickness, the calking being carried out in the region of the end-side section. Furthermore, the provision of the sliding element can take place in an arrangement in a bearing bracket of a camshaft module, with the result that the calking of the support tube on the splined shaft is performed in or on the camshaft module. To this end, a correspondingly suitable calking tool can be provided, by way of which the calking of the sliding element on the splined shaft is carried out, the calking particularly advantageously not being performed until the sliding element is already arranged in a bearing bracket of a camshaft module.

FIG. 1 shows a section of a splined shaft 14 and, by way of example, a single sliding element 10, and the sliding element 10, as well as further sliding elements 10, can be pushed onto the splined shaft 14 in order to form a camshaft. For the transmission of torque between the sliding element 10 and the splined shaft 14, the sliding element 10 comprises an internal spline system 15 in a passage, and the splined shaft 14 comprises an external spline system 16. It is shown, furthermore, that two interruptions 18 are made in the splined shaft 14, which interruptions 18 are at an axial spacing from one another which corresponds to the axial spacing of end-side sections 20 of the sliding element 10. When the splined shaft 14 is introduced into the sliding element 10, the internal spline system 15 engages into the external spline system 16. In this way, the sliding element 10 is arranged fixedly on the splined shaft 14 so as to rotate with it and such that it can be displaced in the axial direction 13.

The sliding element 10 comprises a support tube 12, and cam elements 11.1 and 11.2 are received on the support tube 12. A bearing bracket 22 which can be a constituent part, for example, of a module cover for forming a camshaft module or a cylinder head is situated between the cam elements 11.1 and 11.2. Here, the sliding element 10 is mounted rotatably via the support tube 12 on a bearing section 21 in the bearing bracket 22.

On the existing end sides, as viewed in the axial direction 13, in particular outside the setting locations for receiving the cam elements 11.1 and 11.2, the support tube 12 comprises the end-side sections 20 with a reduced wall thickness. The reduced wall thickness results from the fact that the external diameter of the support tube 12 is reduced in the end-side sections 20. When the splined shaft 14 is introduced into the sliding element 10 in the arrow direction which is shown, the arrangement according to FIG. 2 is produced, as described in the following text.

Figure 2:
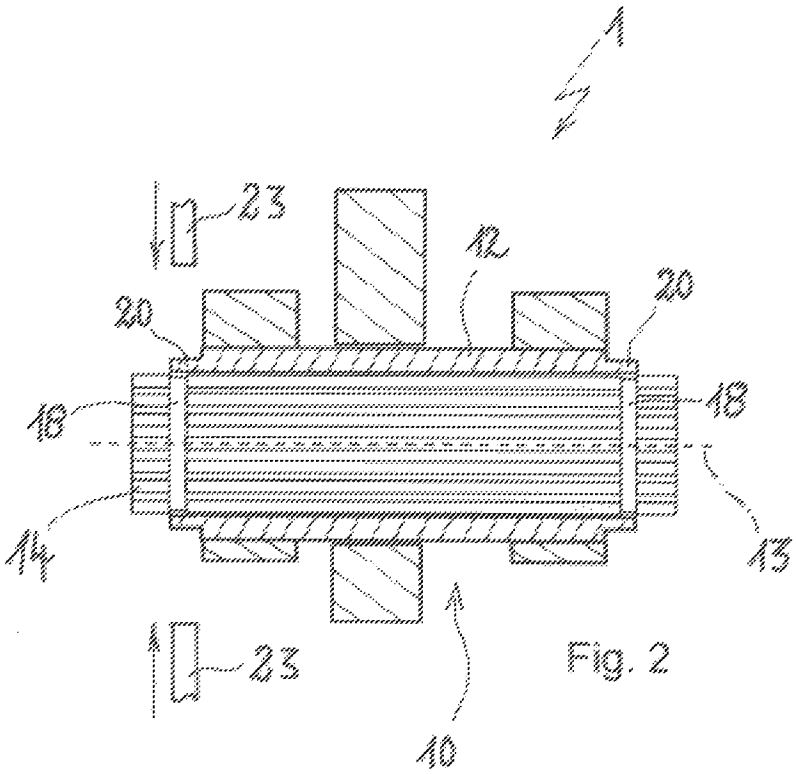
FIG. 2 is a sectional view of the example camshaft of FIG.1, with the example sliding element being arranged on the example splined shaft.

FIG. 2 shows a camshaft 1 in a view in sections, the splined shaft 14 being guided through a sliding element 10, and the splined shaft 14 comprising two interruptions 18 in the form of circumferential grooves, and the interruptions 18 corresponding by way of the axial position along the axial direction 13 with the end-side sections 20. A calking tool 23 serves to calk the support tube 12 on the splined shaft 14, which calking tool 23 is shown with two punches which can be moved radially in the arrow direction onto the end-side section 20 for plastic deformation. When the calking tool 23 is activated, local calking of the end-side section 20 into the interruption 18 of the splined shaft 14 can be achieved, as shown in the following FIG. 3.

Figure 3:
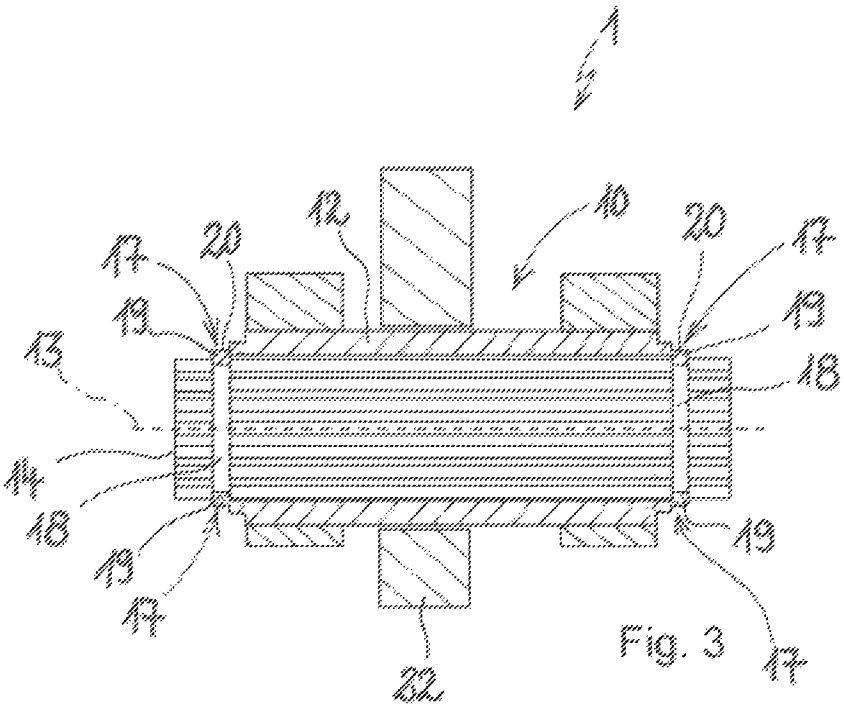
FIG. 3 is a section view of an example camshaft with a sliding element that is secured axially on a splined shaft via a calked connection of a support tube to the splined shaft.

FIG. 3 shows a view in sections of the camshaft 1 with the splined shaft 14, on which the sliding element 10 is received. As viewed in the axial direction 13, the support tube 12 is delimited on both end sides by way of the end-side section 20, and material parts 19 of the end-side sections 20 have been calked in sections into the interruption 18 by way of plastic deformation, by the calking tool 23 having been activated, as shown in FIG. 2. A positively locking connection in the axial direction 13 is produced between the support tube 12 and the splined shaft 14 by way of the material part 19 being formed in sections into the interruption 18, as a result of which the sliding element 10 is fixed on the splined shaft 14 such that it cannot be displaced in the axial direction 13.

The sliding element 10 is received by way of example in a bearing bracket 22, and further sliding elements 10 can be received on the splined shaft 14 adjacently with respect to the fixed sliding element 10 which is shown, which further sliding elements 10 remain axially displaceable and can likewise be received in bearing brackets 22.

The implementation of the invention is not restricted to the preferred exemplary embodiment which is specified above. Rather, a number of variants are conceivable which use the solution which is shown, even in the case of embodiments of a fundamentally different type. All of the features and/or advantages which are apparent from the claims, the description or the drawings, including structural details or spatial arrangements, can be essential to the invention both per se and in a very wide variety of combinations.

LIST OF DESIGNATIONS

1 Camshaft
10 Sliding element
11.1 Cam element
11.2 Cam element
12 Support tube
13 Axial direction
14 Splined shaft
15 Internal spline system
16 External spline system
17 Calked connection
18 Interruption
19 Material part in sections
20 End-side section
21 Bearing section
22 Bearing bracket
23 Calking tool

What is claimed is:

1. A camshaft for a multiple-cylinder internal combustion engine, the camshaft comprising:

a sliding element comprising at least two cam elements for selective control of valves of the multiple-cylinder internal combustion engine, wherein the sliding element includes an internal spline system; and a splined shaft extending in an axial direction, wherein the sliding element is received on the splined shaft, wherein the internal spline system of the sliding element interacts with an external spline system of the splined shaft such that the sliding element is seated fixedly on the splined shaft so as to rotate with the splined shaft, wherein the sliding element is received on the splined shaft in an axially displaceable manner, wherein the sliding element is configured to be fixed in the axial direction to the splined shaft by way of a positively locking connection comprising a calked connection between the sliding element and the splined shaft.

2. The camshaft of claim 1 further comprising a plurality of sliding elements, with the sliding element being one of the plurality of sliding elements.

3. The camshaft of claim 1 wherein at least one of the splined shaft comprises an interruption of the external spline system at an axial position, wherein a part of the sliding element is calked in sections, or the sliding element comprises a receiving geometry into which a part of the splined shaft is calked in sections.

4. The camshaft of claim 1 wherein the sliding element comprises a support tube on which the at least two cam elements are received, wherein the calked connection exists between the support tube of the sliding element and the splined shaft.

5. The camshaft of claim 4 wherein the support tube comprises an end-side section with a reduced tube wall thickness, wherein the calked connection is configured in a region of the end-side section of the support tube.

6. The camshaft of claim 1 wherein the sliding element comprises axial end sides, the camshaft further comprising at least two calked connections between the sliding element and the splined shaft on each of the axial end sides of the sliding element, wherein the at least two calked connections are distributed about a circumference of the splined shaft.

7. The camshaft of claim 1 wherein the sliding element comprises axial end sides, the camshaft further comprising at least three calked connections between the sliding element and the splined shaft on each of the axial end sides of the sliding element, wherein the at least three calked connections are distributed about a circumference of the splined shaft.

8. The camshaft of claim 1 wherein the sliding element comprises axial end sides, the camshaft further comprising four calked connections between the sliding element and the splined shaft on each of the axial end sides of the sliding element, wherein the four calked connections are distributed about a circumference of the splined shaft.

9. The camshaft of claim 1 wherein the splined shaft comprises an interruption of the external spline system at an axial position, wherein the interruption comprises a circumferential groove in the splined shaft.

10. The camshaft of claim 1 wherein the sliding element includes a bearing section by way of which the sliding element can be received in a rotatably mountable manner on a bearing bracket.

11. A method for producing a camshaft for a multiple-cylinder internal combustion engine, the method comprising:

providing a sliding element with at least two cam elements for selective control of valves of the multiple-cylinder internal combustion engine, wherein the sliding element includes an internal spline system;

providing a splined shaft that extends in an axial direction and includes an external spline system;

guiding the splined shaft through the sliding element so that the sliding element is seated fixedly on the splined shaft and rotates with the splined shaft due to interaction between the internal and external spline systems, wherein the sliding element is axially displaceable with respect to the splined shaft; and producing a calked connection between the sliding element and the splined shaft to fix the sliding element in the axial direction on the splined shaft.

12. The method of claim 11 wherein the sliding element that is provided includes a support tube comprising an end-side section with a reduced tube wall thickness, wherein the calked connection is produced in a region of the end-side section.

13. The method of claim 11 wherein the sliding element is provided in a bearing bracket of a camshaft module such that calking of the support tube on the splined shaft is performed in or on the camshaft module.

14. The method of claim 11 further comprising providing a calking tool for producing the calked connection between the sliding element and the splined shaft, wherein the calked connection is produced when the sliding element is positioned in a bearing bracket of a camshaft module.

* * * * *